US005475194A

United States Patent [19]

Watanabe et al.

[11] Patent Number: 5,475,194

[45] Date of Patent: Dec. 12, 1995

[54] IMAGE HEATING APPARATUS HAVING DEVICE FOR DETECTING SHIFT OF ENDLESS BELT, STOPPING DRIVE OF ENDLESS BELT AND RESTARTING THEREAFTER

[75] Inventors: Osamu Watanabe, Tokyo; Hidekazu Maruta, Yokohama, both of Japan

[73] Assignee: Canon Kabushiki Kaisha, Tokyo, Japan

[21] Appl. No.: 159,209

[22] Filed: Nov. 30, 1993

[30] Foreign Application Priority Data

Dec. 4, 1992 [JP] Japan ..... 4-350235

[51] Int. Cl.[6] ..... G03G 15/20

[52] U.S. Cl. ..... 219/216; 355/285; 355/207

[58] Field of Search ..... 355/282, 285, 355/289, 290, 212, 205–208; 219/216, 469

[56] References Cited

U.S. PATENT DOCUMENTS

| | | | |
|---|---|---|---|
| 3,820,888 | 6/1974 | Jordon | 355/212 |
| 4,429,985 | 2/1984 | Yokota | 355/212 |
| 5,027,160 | 6/1991 | Okada et al. | 355/282 |
| 5,043,763 | 8/1991 | Koh et al. | 355/206 |
| 5,091,752 | 2/1992 | Okada | 355/285 |
| 5,118,920 | 6/1992 | Tanabe et al. | 219/216 |
| 5,149,941 | 9/1992 | Hirabayashi et al. | 219/216 |
| 5,153,655 | 10/1992 | Suzuki | 355/285 |
| 5,157,444 | 10/1992 | Mori et al. | 355/282 |
| 5,162,634 | 11/1992 | Kusaka et al. | 219/216 |
| 5,182,606 | 1/1993 | Yamamoto et al. | 355/289 |
| 5,262,834 | 11/1993 | Kusaka et al. | 355/285 |
| 5,267,005 | 11/1993 | Yamamoto et al. | 355/290 |

FOREIGN PATENT DOCUMENTS

| | | | |
|---|---|---|---|
| 0519454 | 12/1992 | European Pat. Off. | 355/282 |
| 0168289 | 6/1990 | Japan | 355/282 |
| 0266381 | 10/1990 | Japan | 355/285 |

*Primary Examiner*—Robert Beatty

*Attorney, Agent, or Firm*—Fitzpatrick, Cella, Harper & Scinto

[57] ABSTRACT

An image heating apparatus includes a heating member; an endless belt for transferring the heat generated by the heating member to an image on a recording material; a driver for driving the endless belt; a driver controlling device for controlling the driver; a detector for detecting a position of the endless belt when the endless belt shifts out of a predetermined range; such that the driver controlling device interrupts driving operation of the driver in response to an output of the detector, and afterward, automatically restarts the driving operation of the driver.

8 Claims, 19 Drawing Sheets

IMAGE HEATING APPARATUS HAVING DEVICE FOR DETECTING SHIFT OF ENDLESS BELT, STOPPING DRIVE OF ENDLESS BELT AND RESTARTING THEREAFTER

FIELD OF INVENTION AND RELATED ART

The present invention relates to an image heating apparatus comprising an endless belt, in particular to an image heating apparatus employed preferably in the fixing apparatus of an image forming apparatus such as a copying machine or printer.

In the past, as an image heating apparatus used for fixing thermally an unfixed image or altering the surface properties of the image, a heat roller type image heating apparatus has been widely in use, in which the recording material carrying the image is advanced by a heating roller and a pressure roller, while being compressed between them. In this heat roller type apparatus, the thermal capacity of the heat roller is rather large; therefore, it has been suffering from such a problem that the time it takes for the heat roller to reach a predetermined temperature (so-called warmup time) is long.

Therefore, in the U.S. Pat. Nos. 5,149,941 and 5,262,834 or the like, a through-film type thermal fixing system is disclosed, in which a low thermal capacity thermal head and a piece of thin film which slides on this thermal head are employed in order to shorten this warmup time.

However, in this type of through-film type heating system, such a phenomenon that the endless film shifts in the axial direction of the film occurs. More specifically, when a recording material is conveyed in an off-centered manner, the temperature distribution becomes uneven across the heater surface and the driving roller, causing thereby the film to shift toward the high temperature side. When the amount of this shift becomes excessive, the film is pushed against the lateral side of the fixing apparatus, causing problems such as the appearance of wrinkles on the film or tearing of the film.

As a means for dealing with such problems, a proposal is disclosed in U.S. Pat. No. 5,027,160, in which, when it is detected that the endless film has shifted to an abnormal location, film driving is stopped so that the damage to the film is avoided.

However, according to this apparatus, the film driving is stopped, with the film having been shifted in the axial direction; therefore, even though the damage to the fixing apparatus itself can be avoided, the apparatus becomes useless since it is not so easy to move the film back to the normal track once the apparatus is in the hand of the consumer.

SUMMARY OF THE INVENTION

Accordingly, a primary object of the present invention is to provide an image heating apparatus capable of preventing damage to the endless belt caused by the abnormal shifting of the endless belt.

Another object of the present invention is to provide an image heating apparatus in which the endless belt having shifted to an extreme end can automatically return to a predetermined track.

According to an aspect of the present invention, the image heating apparatus comprises: a heating member; an endless belt for transferring the heat generated by a heating member to an image borne on a recording material; driving means for driving said endless belt; driving means controlling means for controlling said driving means; detecting means for detecting the position of said endless belt when said endless belt shifts out of a predetermined range; wherein said driving means controlling means interrupts the driving operation of said driving means in response to the output of said detecting means, and afterward, automatically restarts the driving operation of said driving means.

These and other objects, features and advantages of the present invention will become more apparent upon a consideration of the following description of the preferred embodiments of the present invention, taken in conjunction with the accompanying drawings.

DESCRIPTION OF THE REFERRED EMBODIMENTS

Embodiment 1

Figure 1:
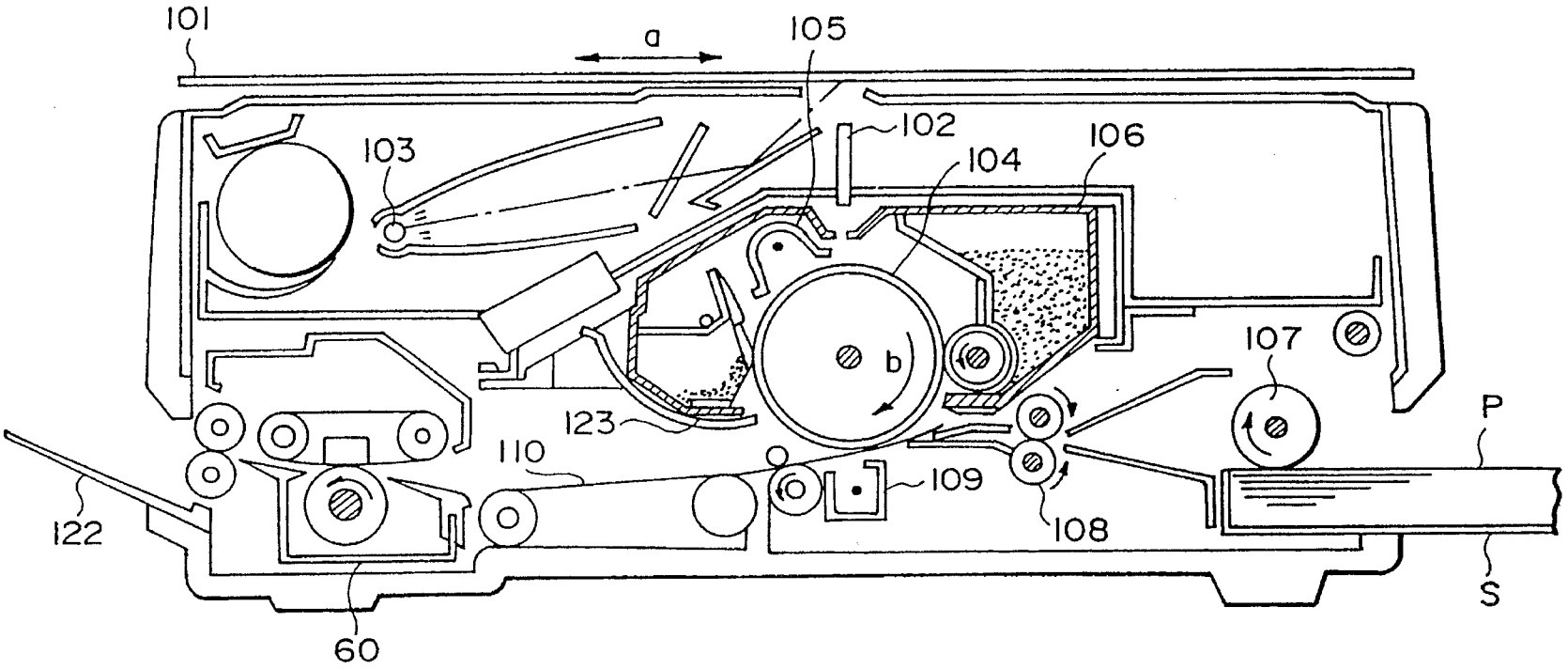
FIG. 1 is a sectional view of a preferred embodiment of the present invention, depicting the general structure.

To begin with, referring to FIGS. 1 to 5, the first embodiment of the present invention will be described. FIG. 1 is an image forming apparatus employing the fixing apparatus according to the first embodiment of the present invention. In FIG. 1, a reference numeral 101 designates a document table made of transparent material such as glass, which reciprocates in the direction indicated by an arrow (a), while scanning an original. Directly below this document table 101, there is an image focusing array 102 having a short focal point and a small diameter. An image on the original placed on the document table 101 is illuminated by an illuminating lamp 103, and the light reflected from the image is focused by the array 102, on a photosensitive drum 104, slit-exposing the surface thereof. Meanwhile, this photosensitive drum 104 rotates in the direction indicated by an arrow (b). Further, a reference numeral 105 designates a charger, which uniformly charges the photosensitive drum 104, the surface of which is coated with photosensitive material such as zinc oxide or an organic semiconductor. As the photosensitive drum 104 having been charged by this charger 105 is exposed to the image focused by the array 102, an electrostatic image is formed. This electrostatic image (electrostatic latent image) is visualized by a developing apparatus 106, with the use of particle toner composed of resin or the like which can be softened and fused by heating. On the other hand, a recording material P such as a sheet of recording paper stored in a cassette S is sent into the image forming apparatus by a feed roller 107 and conveyed further to be placed in contact with the peripheral surface of the photosensitive drum 104, by a pair of conveyer rollers 108 rotated in synchronization with the image on the photosensitive drum 104, while being pressed to each other in the vertical direction. There, the toner image, having been formed on the photosensitive drum 104, is transferred onto the recording material P by a transfer charger 109. Thereafter, the recording material P, separated from the photosensitive drum 104 by any known separating means, is guided by a conveyer guide 110 to a fixing apparatus 60, where it is subjected to a thermal fixing process, and is then discharged onto a tray 122. Meanwhile, the residual toner on the photosensitive drum 104 is removed by a cleaner 123 after the toner image is transferred.

Figure 2:
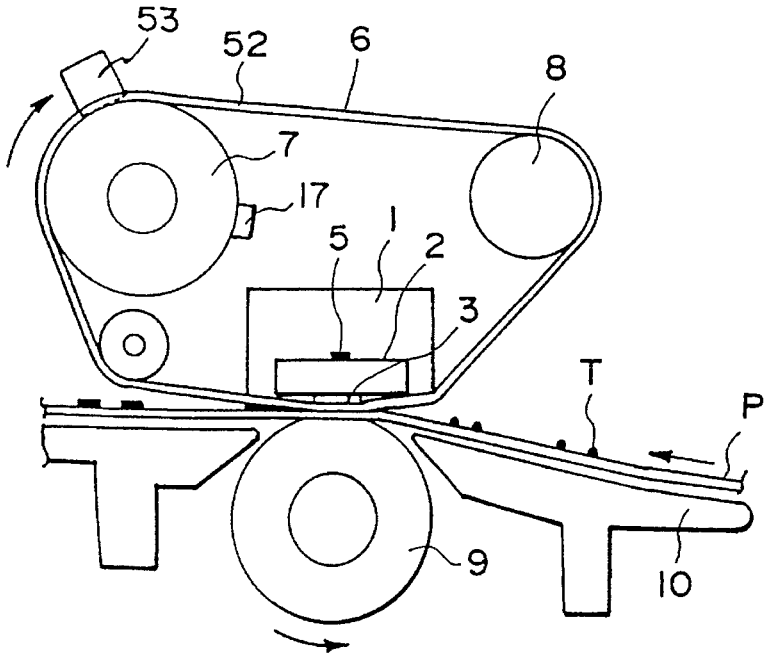
FIG. 2 is a sectional view of the fixing apparatus according to the first embodiment of the present invention, depicting the general structure.

FIG. 2 is an enlarged sectional view of the fixing apparatus 60. In FIG. 2, a reference numeral 1 designates a linear heating member of a small heat capacity, which is a 1.0 mm thick and 10 mm wide strip of electrically resistive material such as silver/palladium coated on an alumina substrate 2 measuring 1.0 mm in thickness, 10 mm in width, and 240 mm in length, and is supplied with the power through the longitudinal opposite ends. The power supply is controlled by an unshown controlling means comprising a microcomputer so that the temperature detected by a temperature detecting element 5 such as a thermistor is kept constant at a predetermined temperature. The temperature detecting element detects the temperature of the heater.

The fixing film 6 moves in the direction indicated by an arrow in the drawing while being in contact with the heating member 1 under the temperature control. This fixing film 6 comprises a 20 μm thick heat resistant endless film and a coating layer, wherein the heat resistant film of, for example, polyimide, polyetherimide, PES, or PFA, is coated at least on the surface which comes in contact with the image, with a separative mixture of fluorinated resin, such as polyimide or PFA, and an electrically conductive material. Generally speaking, the overall thickness of the fixing film is less than 100 μm, preferably no more than 40 μm. This fixing film 6 is driven by a driving roller 7 and a follower roller 8, being imparted with tension and therefore, without wrinkling.

A reference numeral 17 designates a temperature detecting element for detecting the surface temperature of the driving roller. Its output signal is sent to an unshown control circuit. A reference numeral 52 in FIGS. 2 and 3 designates a rib, which is composed of a material different from that of the film 6, and is glued to the film 6. A reference numeral 53 is a regulating member for regulating the rib 52, and is provided alongside the circumference of the end portion of the driving roller 7, on the film center side of the rib 52. As the driving roller 7 rotates and the film 6 is advanced, a force is generated to shift the film 6 in the axial direction. However, when the film shifts in the direction indicated by an arrow R in FIG. 3, the rib 52 comes in contact with the regulating member 53, being thereby regulated. The regulating member 53 follows the shifting movement of the film, but since the regulating member 53 is provided with a spring 40 for preventing the film from shifting, the amount of film shift is controlled.

A reference numeral 9 designates a pressure roller comprising an elastic layer of rubber, for example, silicone rubber, having excellent separative properties. The pressure roller 9 presses on the heating member, with an overall pressure of 4–7 kg, with the film being interposed. As the pressure roller 9 rotates, the recording material P is guided by an entrance guide 10 into the fixing station, where the unfixed toner T on the recording material P is compressed on the film, whereby it is subjected to the aforementioned heat, becoming a fixed image.

Next, referring to FIGS. 3, 4, and 5, an operation of this embodiment will be described. FIG. 4 is a flowchart for the general operation of the fixing apparatus according to this embodiment. During the copying operation, when the film shifts in the axial direction and the resultant abnormal position is detected, the power supply to the heater is interrupted to stop the film rotation (S1–S4). Then, the fixing apparatus naturally cools down. As soon as the driving roller temperature detected by the temperature detecting element 17 falls below a predetermined one, the driving of the fixing apparatus (hereinafter, called "idling") is restarted while maintaining a target temperature of T° C. (S5–S6). As a result, the film returns to the normal position (S7–S8).

Figure 5:
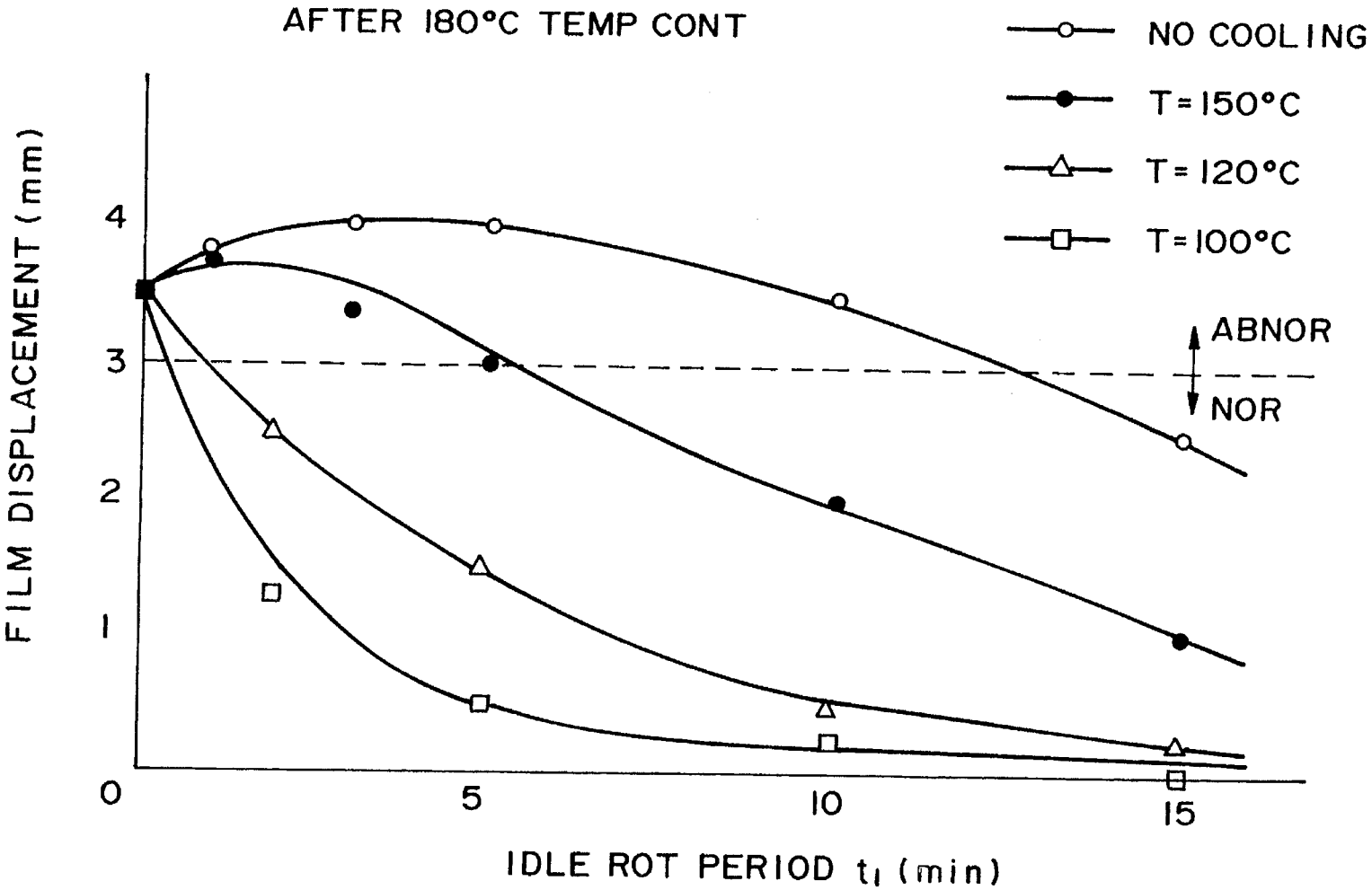
FIG. 5 is a graph of changes in the amount of the film shifting during the idle film rotation, with a supporting member temperature being the parameter, in the apparatus shown in FIG. 2.

FIG. 5 shows the changes in the amount of film shift during the idling period after the fixing apparatus was continuously operated under a temperature control at 180°

C.; the film abnormally shifted; the fixing apparatus was interrupted in response to the detection of the abnormal shifting; the fixing apparatus was allowed to cool naturally down to T° C. When the idling was started without cooling, the film further shifted, increasing thereby the idling time it took for the film to return to the normal position. On the contrary, when the film was allowed to cool down to the predetermined temperature, the film quickly returned to the normal track range, wherein the lower the temperature T was, the less idling time it took for the film position to become normal.

Figure 3:
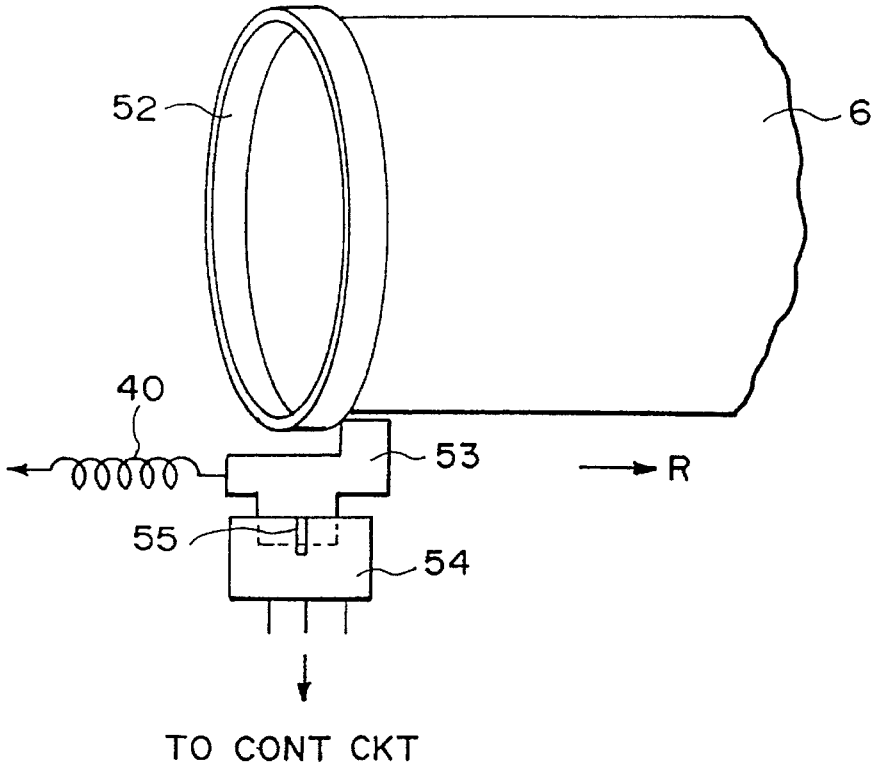
FIG. 3 is a schematic view of the film member and the film member position detecting means in the apparatus in FIG. 2, depicting their general structures.
Figure 4:
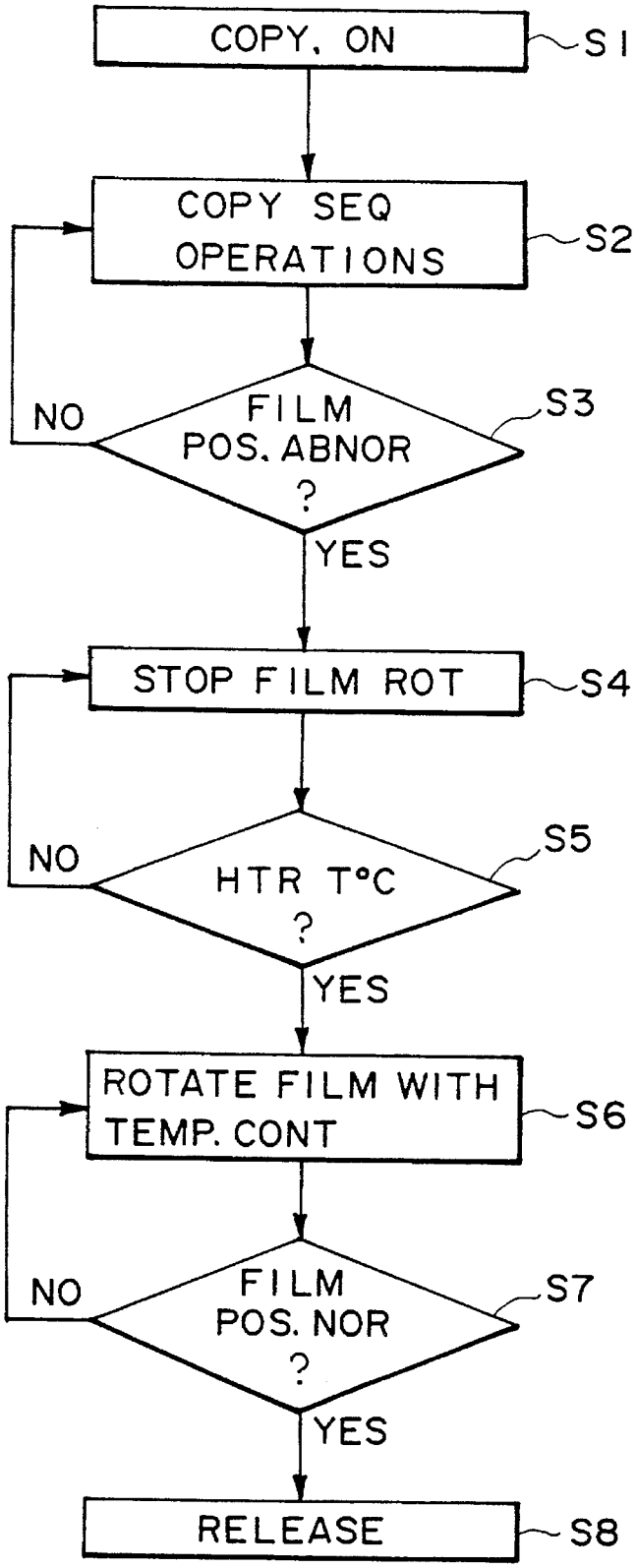
FIG. 4 is a flowchart for a general operation to correct the film member shift in the apparatus shown in FIG. 2.

Referring to FIG. 3, the detection of the abnormal film shifting will be described. As the film 6 shift in the R direction, the regulating member 53 is subjected to a load through the rib 52, moving also in the R direction. Then, the flag portion 55 of the regulating member 53, which has been shielding an optical sensor 54 before the film shifting, moves, changing the state of the optical switch from ON to OFF. This signal is sent to the control circuit.

In this embodiment, the flag portion 55 is 8 mm in width, and in the initial setting, its center point is aligned with the center of the optical sensor 54. When it shifts by a distance of 4 mm, a signal is generated to be sent to the control circuit, whereby the abnormal amount (4 mm) of the film shift is detected.

The abnormal amount of shifting is detected as described in the foregoing, the driving of the film is interrupted; the temperature is allowed to fall to the predetermined one T; and then, the idling is restarted. As a result, the film can return to the normal track.

In this embodiment, a distance of 4 mm was set up as the abnormal distance, but a much longer distance may be set up within the limitations of the apparatus structure. Also, the tolerable shifting distance may be differently set up between the right and left sides of the film.

Embodiment 2

Next, referring to FIG. 6, the second embodiment of the present invention will be described. The same components as those in Embodiment 1 are designated by the same reference numerals to omit their descriptions.

Figure 6:
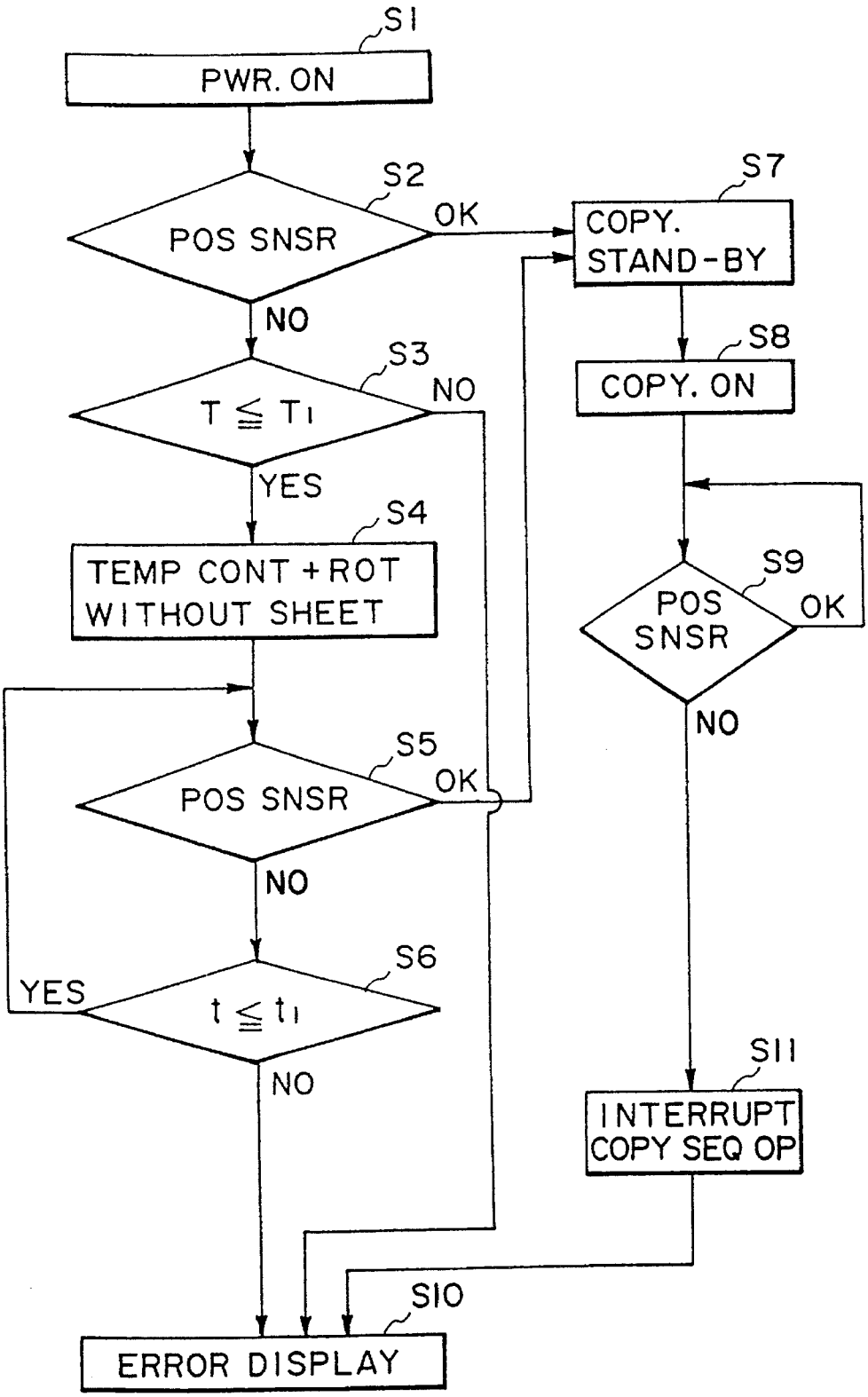
FIG. 6 is a flowchart for a general operation to correct the film member shift in the second embodiment.

FIG. 6 is a flowchart for the general operation of this embodiment. After the power switch is turned on in S1, it is detected in S2 whether or not the film position is abnormal. When it is abnormal, the idling is started if (S3) the surface temperature of the driving roller is below $T_1$. Then, when the film position is detected to be normal again, the operation proceeds to the normal copying sequence. When the film is still on the abnormal track, the idling is continued while measuring the idling time in S6. When the anomaly lasts more than a given period, an error message is displayed in S10.

During the copying operation (S7, S8), when the positional anomaly is detected, the copying sequence is interrupted, and the error message is displayed. After the error message is displayed in S10, it is necessary to turn on the main switch; therefore, the operation returns to S1.

In this embodiment, the duration of idling is limited, and a function to display the error message is provided; therefore, even when damage such as a peeled rib are erroneously detected as the positional anomaly, the film is prevented from being idly driven for an excessively long time, and an operator also can be informed of the anomaly. According to FIG. 5 depicting Embodiment 1, a proper duration t of the idling time is 30 seconds to 5 minutes when T is between 100° C. and 150° C.

Embodiment 3

Next, referring to FIGS. 7(*a*), 7(*b*) and 8, the third embodiment of the present invention will be described, wherein the same components as those in Embodiment 1 are designated by the same reference numerals to omit their descriptions.

Figure 7A:
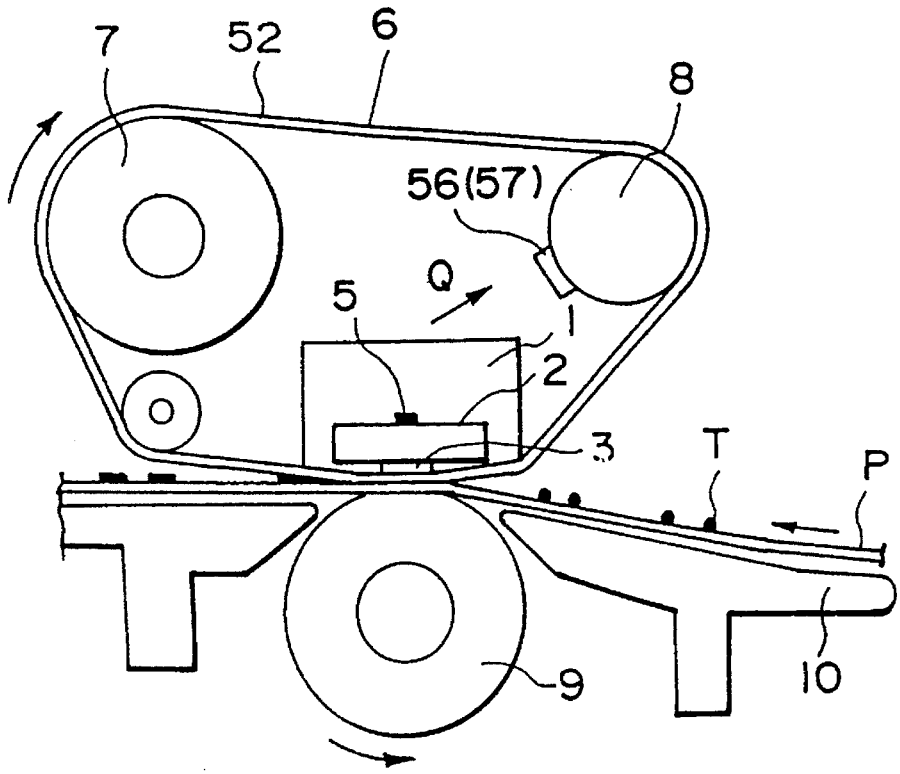
FIGS. 7(*a*) and 7(*b*) are a sectional view of the fixing apparatus according to the third embodiment of the present invention, depicting the general structure.
Figure 7B:
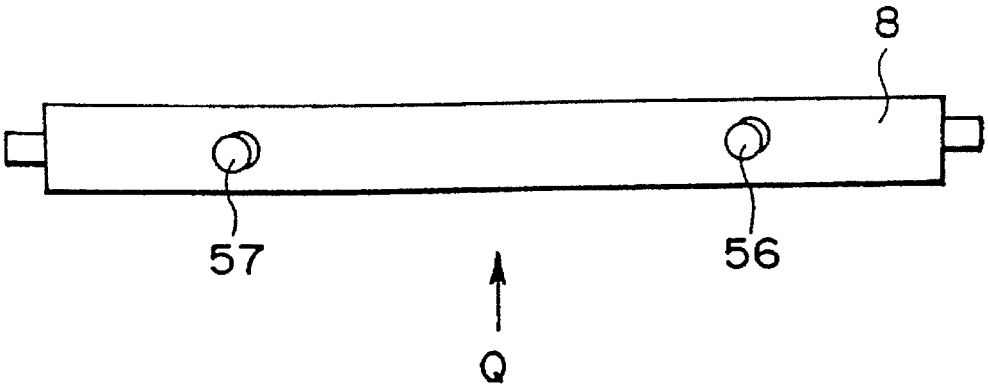

In this embodiment, two thermistors 56, 57 are provided as means for detecting the temperature of the follower roller, being arranged in the longitudinal direction of the roller, as shown in FIG. 7(*b*), and the temperatures detected by these thermistors are designated as $T_A$ and $T_B$, respectively. Reference letters Q show the relative orientation of roller 8 in FIGS. 7(*a*) and 7(*b*). When $|T_A-T_B|$, the absolute value of the difference between $T_A$ and $T_B$, becomes less than a predetermined value, or when T falls below $T_1$, the film rotation is restarted for idling.

Figure 8:
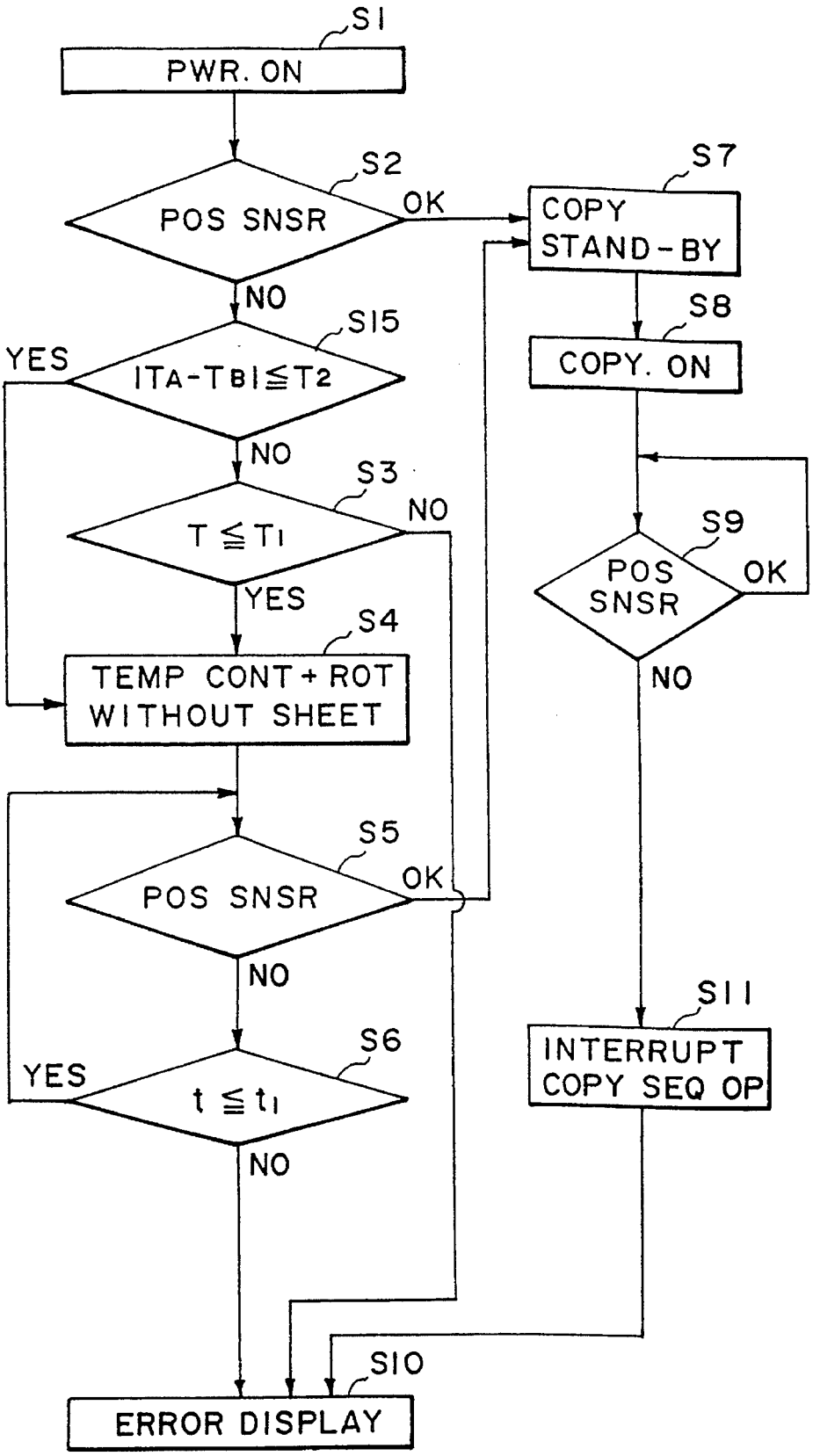
FIG. 8 is a flowchart for a general operation to correct the film member shift in the apparatus shown in FIG. 7.

FIG. 8 is a flowchart for this embodiment. The temperature difference is detected in S15. When the sheet passage is off-set from the center line, the temperature distribution is disturbed, whereby the idling is started much earlier than in Embodiment 1. The test results shows that it is preferable for the reference value for $|T_A-T_B|$ to be set at a value lower than 10° C.

Embodiment 4

Next, referring to FIG. 9, the fourth embodiment will be described, wherein the same components as those in Embodiment 1 are designated by the same reference numerals to omit their description.

Figure 9:
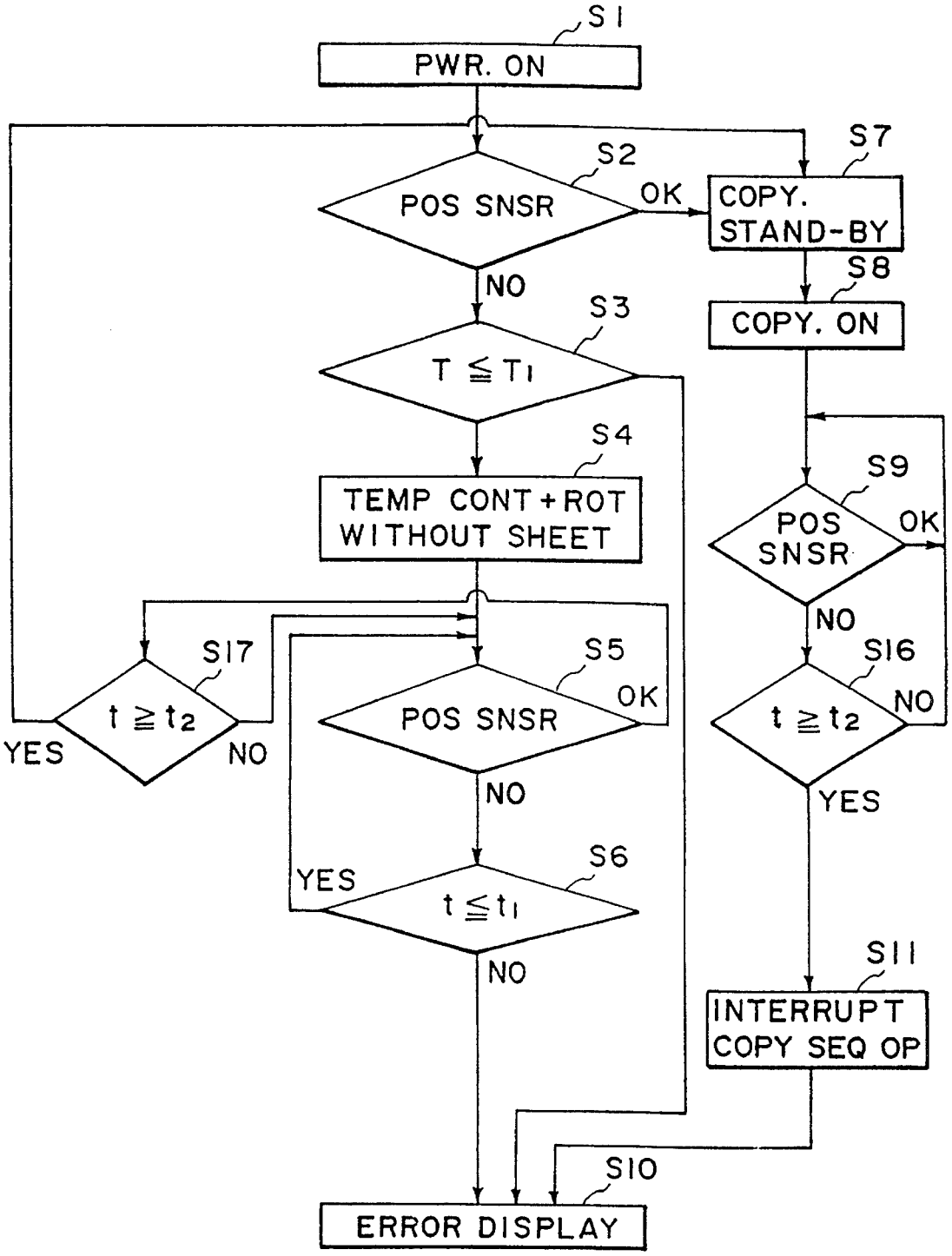
FIG. 9 is a flowchart for a general operation to correct the film member shift in the fourth embodiment of the present invention.

FIG. 9 is a flowchart for the operation of the image forming apparatus according to this embodiment. In FIG. 9, when the position sensor issue an OK signal in S5, the operation goes to S17. In S17, when $t \geqq t_2$, the operation goes to S7, where the apparatus remains on copy-standby, and when t does not satisfy: $t \geqq t_2$, the operation returns to S5, where the position sensor again senses the film position. Therefore, unless the position sensor issues the OK signal for more than a given duration of $t_2$, the apparatus cannot enter the copy-standby state.

As a result, the optical sensor is prevented from being repeatedly turned on and off due to rib vibrations or the like, preventing thereby erroneous operations. The relation between stages S16 and S9 is the same as that described in the foregoing.

Embodiment 5

Next, referring to FIGS. 10(*a*) and 10(*b*), the fifth embodiment of the present invention will be described, wherein the same components as those in Embodiment 1 are designated by the same reference numerals to omit their descriptions.

Figure 10A:
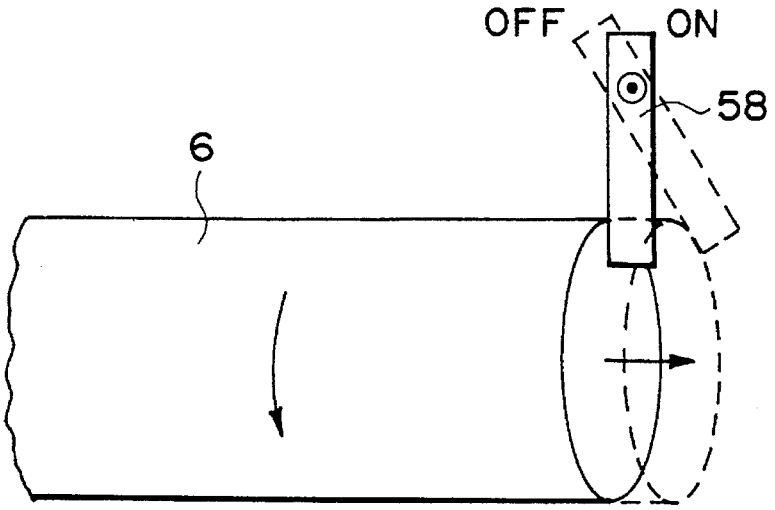
FIGS. 10(*a*) and 10(*b*) are schematic views of a different form of the film member position detecting member in the fifth embodiment.
Figure 10B:
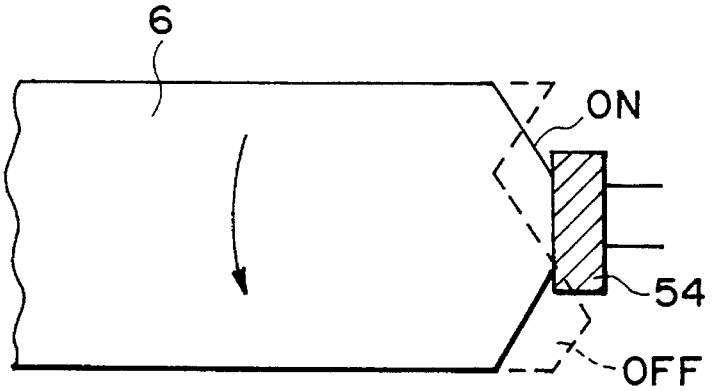
Figure 10B:
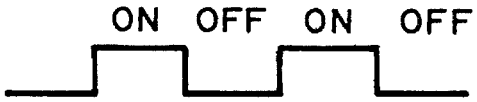

FIGS. 10(*a*) and 10(*b*) depicts a means for detecting the film position in this embodiment. FIG. 10(*a*) shows one which detects the film position with the use of a lever 58, and FIG. 10(*b*) depicts a method in which the angular cutaway portion of the film edge is optically detected, and the ratio between the ON and OFF periods is used to determine the film position.

When the abnormal shifting of the film is detected, the rotation of the film is interrupted. In addition, when the positional anomaly is detected, a signal may be generated, in response to which the follower roller shown in FIG. 2 may be electrically or mechanically moved in the vertical direction, as the means for effectively preventing the film from shifting.

Embodiment 6

Next, referring to FIGS. 11 to 20, the sixth embodiment of the present invention will be described. Here, the image forming apparatus according to this embodiment is the same as that shown in FIG. 1, in its general structure, and the same components as those in Embodiment 1 are designated by the same reference numerals to omit their descriptions.

Figure 11:
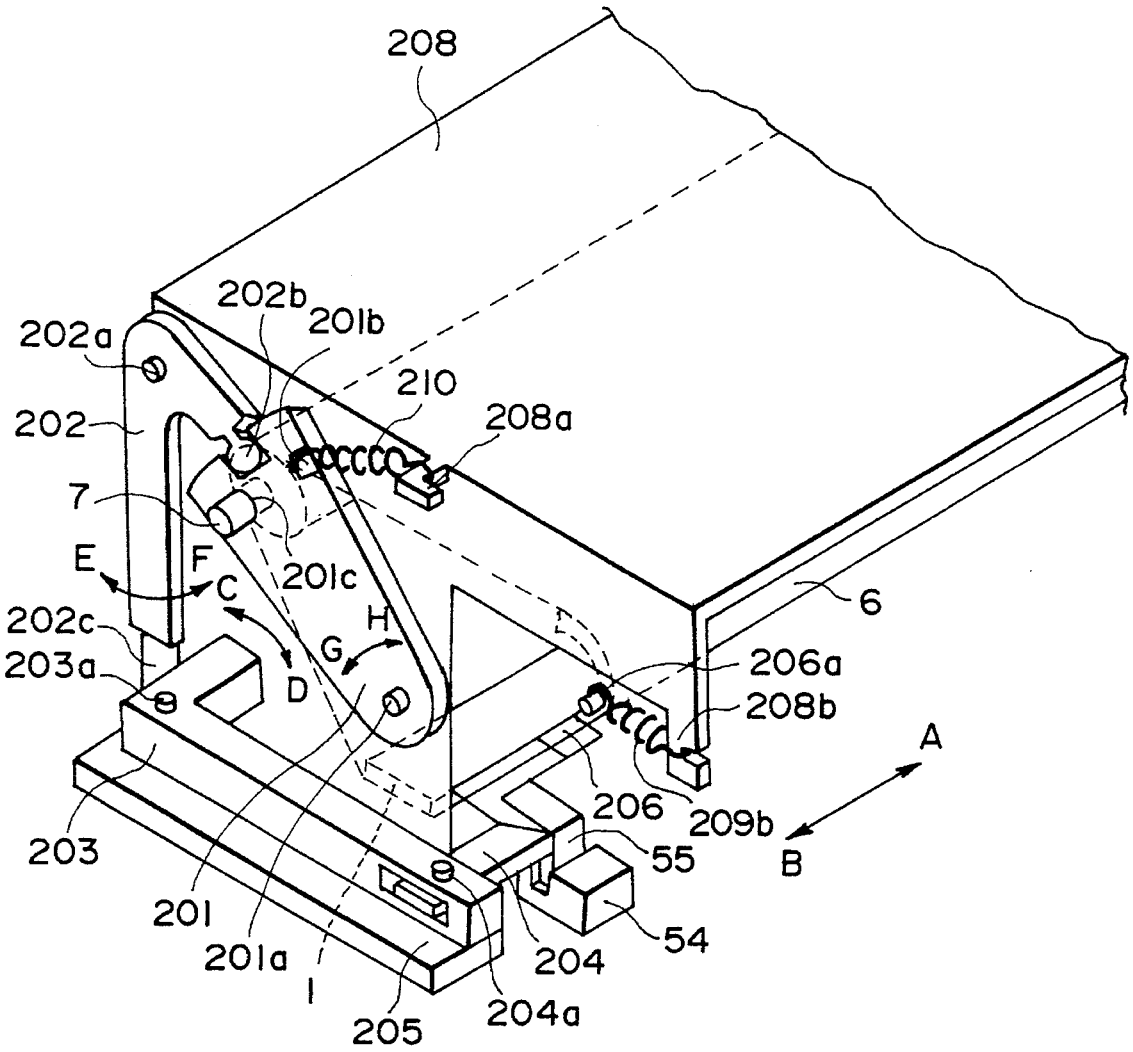
FIG. 11 is an oblique view of the film member position detecting means in the sixth embodiment of the present invention, depicting the general structure.

FIG. 11 is an oblique view of the fixing apparatus according to this embodiment. In FIG. 11, a reference numeral 201 designates an arm, which is provided with a spring anchoring portion 201*b*, and rotates about an axis 201*a*. A reference numeral 202 also designates an arm, which rotates about an axis 202*a* and its columnar portion is engaged with the arm 201. In addition, a reference numeral 203 also designates an arm, which rotates about an axis 203*a* erected on a wall 205 and is engaged with a columnar portion of the arm 202. A reference numeral 204 designates a regulating member, which rotates about an axis 204*a* provided on the arm 201. A reference numeral 206 designates a tension plate, which is spring-loaded by a tension spring 209*b* attached to member 206*a* to provide the film 6 with tension.

FIG. 11 shows only the front side of the fixing apparatus, but the tension plate 206 is spring-loaded by the tension spring 209*b*, also in the rear side (unshown).

A reference numeral 208 designates a side plate provided spring anchoring members 208*a* and 208*b*. A reference numeral 210 designates a tension spring, which is stretched between the arm 201 and the side plate, by the spring anchoring portions 201*b* and 208*a*, respectively. This tension spring 210 generates tension to pull the arm 201 in the direction indicated by an arrow H, so that the fixing film 6 is given a built-in characteristic to shift toward the rear side (direction indicated by an arrow A).

In other words, while the regulating member 204 is not subjected to the force of the shifting film, only the front side of the driving roller 7 which gives tension to the film 6 is pulled in the arrow H direction, whereby the front side of the driving roller 7 is slightly displaced in the H direction compared to the rear side; therefore, the shifting direction of the fixing film 6 is set up to be the rearward direction.

This tension spring 210 has a force strong enough to resist the reactive force generated by the rotation of the driving roller 7, so that the front side of the driving roller 7 is prevented from moving downward.

A reference numeral 6 designates the same fixing film as that in Embodiment 1, which comprises an approximately 20 μm thick film of heat resistant resin such as PI (polyimide), PEI (polyetherimide), PES (polyether sulfon), and an approximately 10 μm thick separative layer of fluorinated resin such as PTFE (polytetrafluoroethylene), coated on the external peripheral surface of the film. The overall thickness of this film is preferred to be less than 100 μm, more preferably no more than 50 μm.

A reference numeral 7 designates a driving roller, which is engaged in a hole 201*c* of the arm 201. In the drawings, arrow marks G–H indicate the directions in which respective arms move.

Figure 12:
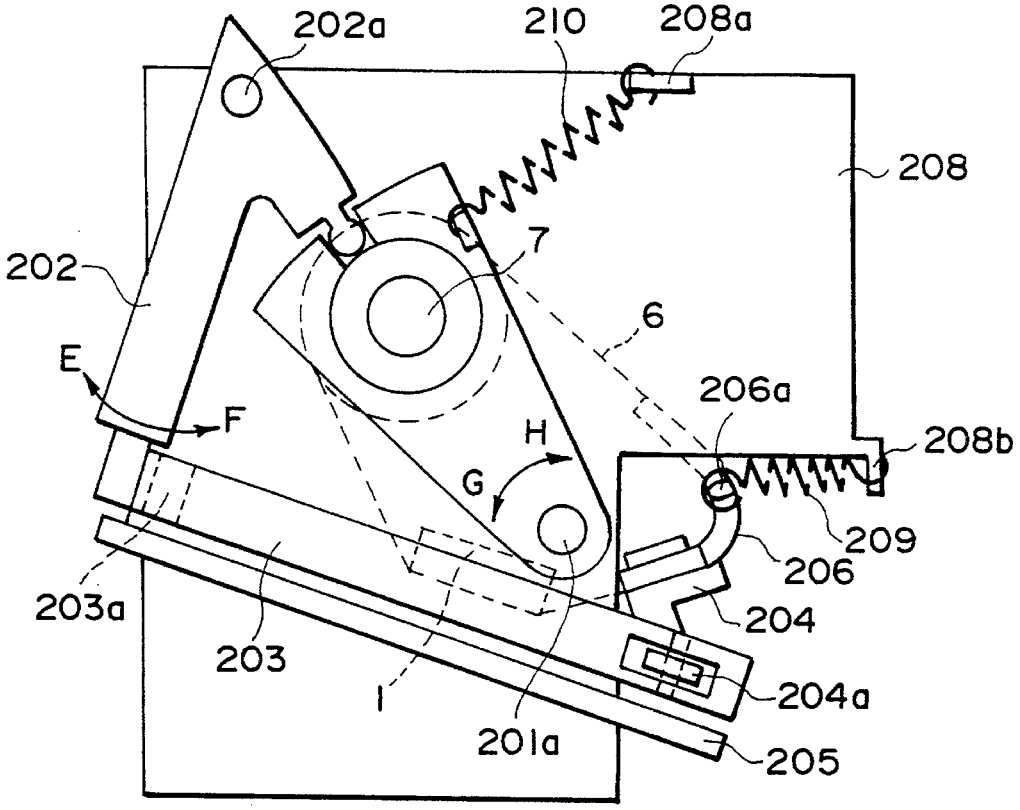
FIG. 12 is a front view of the apparatus in FIG. 11.
Figure 13:
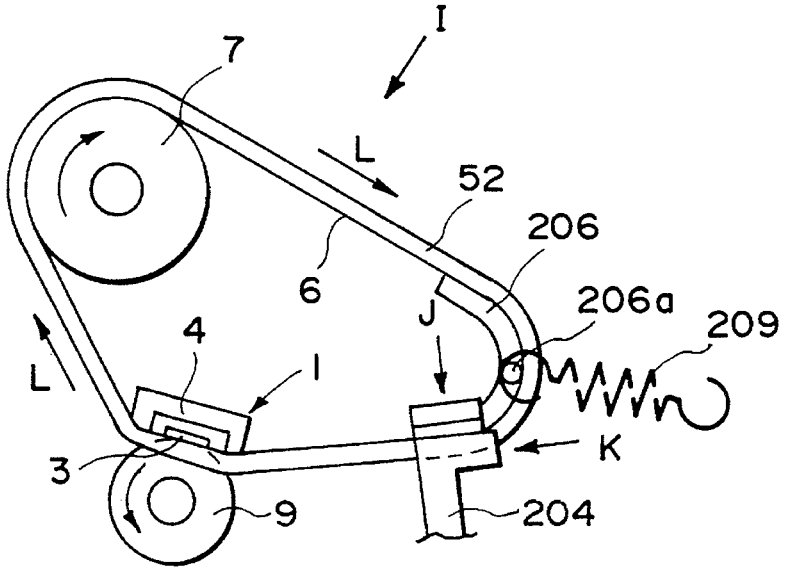
FIG. 13 is a sectional view of the fixing apparatus in the sixth embodiment of the present invention.

FIG. 12 is a front view of FIG. 11, and FIG. 13 is a front view of the side plate 108. A reference numeral 52 designates a rib provided on the fixing film 6, alongside the peripheral edge on the front side. This rib is integrally formed with the heat resistant resin portion of the film 6. It is also acceptable to glue afterward a rib made of slippery material of different kind to the fixing film.

The fixing film 6 is stretched around the driving roller 7, the tension plate 206 pulled by the tension spring 209, and the heating member 1. The heating member 1 is structured in such a manner that an exothermic layer 3 is supported by a holder 4. A reference numeral 9 designates a pressure roller, which presses the fixing film on the heating member 1, with a force necessary for fixing operation. As the diving roller 7 rotates in the direction indicated by an arrow, the fixing film is advanced in the direction indicated by an arrow L.

Figure 14:
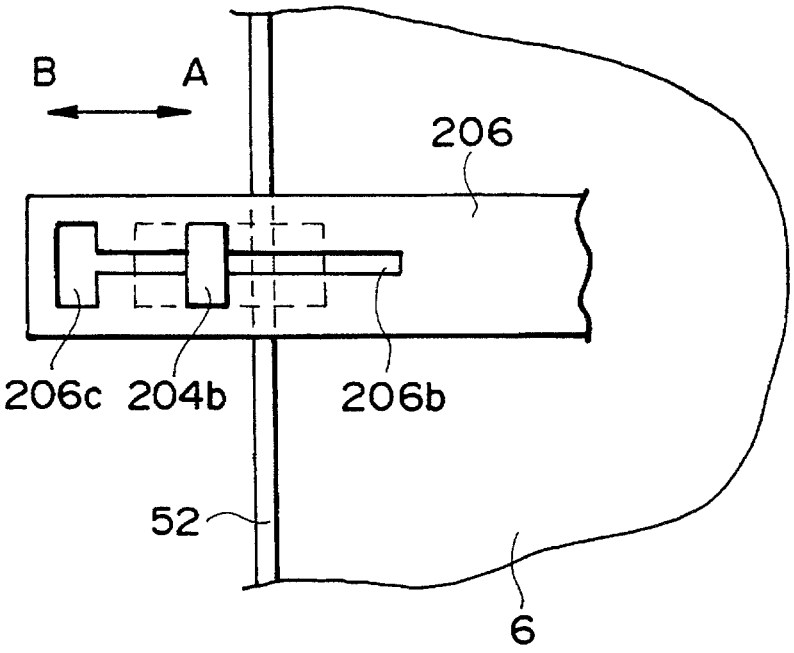
FIG. 14 is a different view of the apparatus in FIG. 13, as seen from the direction indicated by an arrow mark J in FIG. 13.

Next, the state of contact between the rib and the regulating member 204 subjected to the shifting force of the film will be described. FIG. 14 is a different view of the device in FIG. 13, as seen from the direction indicated by an arrow J. The tension plate 206 is provided with holes 206*b* and 206*c*. The hole 206*b* serves as a guiding portion for guiding the 204*b* portion of the regulating member 204 in the directions indicated by arrows A and B. The hole 206*c* is formed to be larger to accommodate the 204*b* portion.

Figure 15:
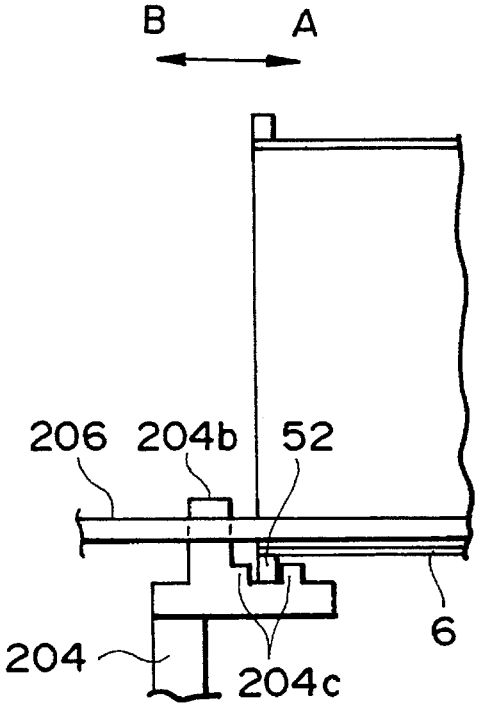
FIG. 15 is another different view of the apparatus in FIG. 13, as seen from the direction indicated by an arrow mark K in FIG. 13.

FIG. 15 is another different view of the device in FIG. 13, as seen from the direction indicated by an arrow K. The rib 52 is positioned between two projections 204*c* of the regulating member. Therefore, when the fixing film 6 shifts in the arrow A or B direction, the rib 52 is affected by the shifting force of the film, whereby the regulating member 204 also moves following the movement of the shifting film.

Figure 16:
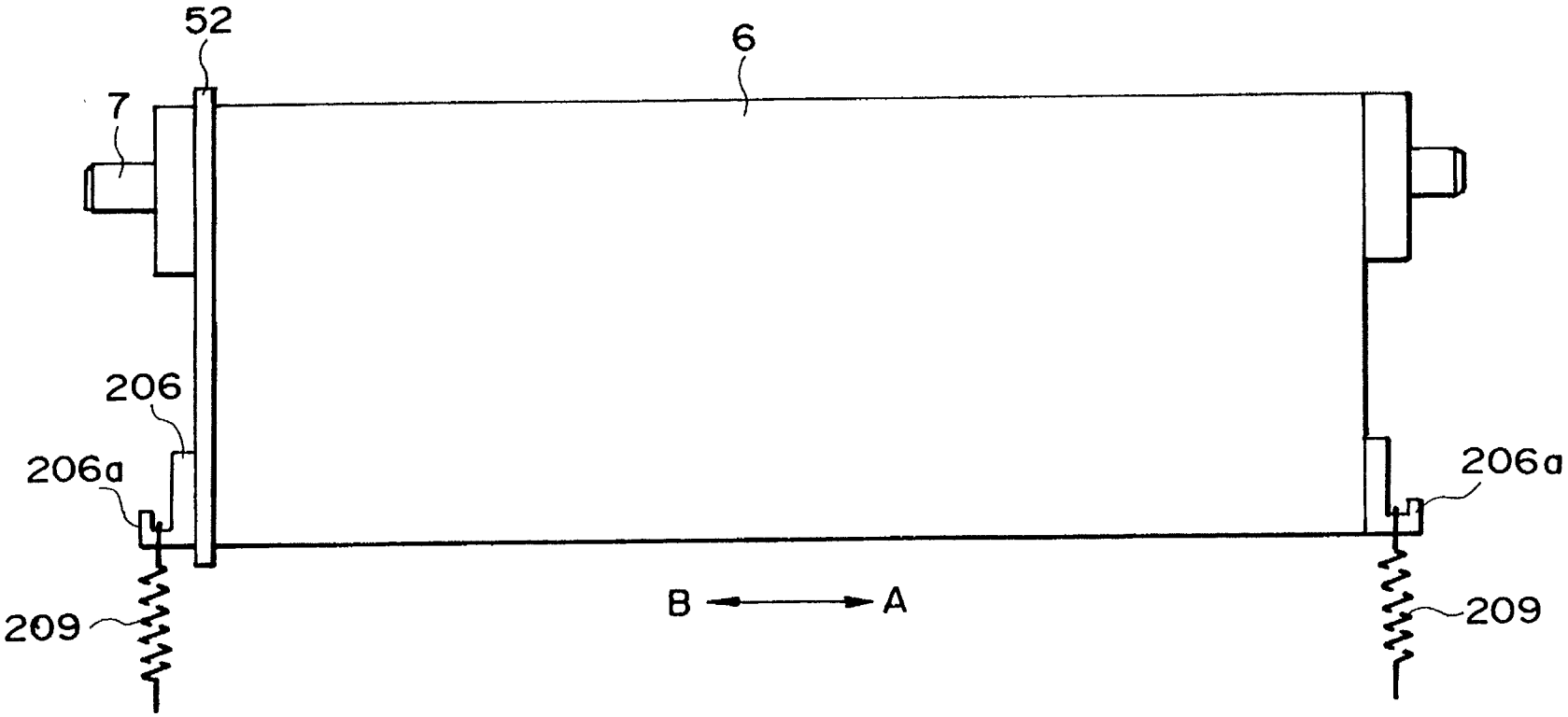
FIG. 16 is another different view of the apparatus in FIG. 13, as seen from the direction indicated by an arrow mark I in FIG. 13.

FIG. 16 is another different view of the device in FIG. 13, as seen from the direction indicated by an arrow I. As shown in the drawing, the rib 52 in this embodiment is provided on the front side (left side) of the fixing film. The tension spring 209 is hooked on the spring anchoring portion of the tension plate 206, providing the fixing film 6 with the tension.

In this embodiment, when the apparatus is not operating, the strength of the tension spring 210 (which is given a build-in characteristic by pulling upward the driving roller 7) is balanced with the magnitude of force with which the fixing film 6 pushes the rib 52. Within the operational range of the regulating member, the force inflicted upon the rib 52 remains approximately constant, except for a slight change in the pulling strength of the tension spring 210, which is caused by the positional change of the driving roller.

Next, the shift preventing function of this embodiment will be described. During the fixing operation, the heating member generates heat, and the fixing film begins to rotate. Let it be assumed that the fixing film begins to shift in the arrow A direction (rearward) in FIG. 11. Since the regulating member is in contact with the fixing film 6, it is subjected to the shifting force of the fixing film 6, being thereby moved in the arrow A direction. Then, the arm 203 engaged with the regulating member 204 rotates about the axis 203*a* in the arrow C direction, pushing up the columnar portion 202*c* of the arm 202 in the arrow E direction. Further, since the columnar portion 202*b* of the arm 202 is engaged with the arm 201, the arm 201 rotates in the arrow G direction.

Therefore, the arrow B side (front side) of the driving roller 7 is pushed downward against the force of the tension spring 210. This reduces the force working to shift the fixing film in the arrow A direction, whereby the shifting of the fixing film 6 in the arrow A direction (rearward) can be canceled.

On the contrary, when the fixing film 6 begins to shift in the arrow B direction (frontward), the regulating member 204 moves in the arrow B direction, forcing thereby the arm 203 to rotate in the arrow D direction. As a result, the arm 201 is freed from the regulation imposed by the arm 203 because the arm 203 which regulates the position of the arm 202 moves away. Therefore, the arm 201 pulled by the tension 210 rotates in the arrow H direction. Thus, the driving roller 7 is moved upward, whereby the fixing film 6 is forced to shift in the arrow A (rearward), canceling the frontward shifting.

As described in the foregoing, according to this embodiment, the force which moves the movable regulating member susceptible to the shifting force of the endless fixing film is converted into the force for displacing the driving roller which provides the film with the tension, with the use of displacing means comprising the arms 201, 202, and 203; therefore, the force working to shift the endless belt is automatically canceled.

Because of this arrangement, the loads inflicted on the fixing film and the rib are substantially reduced, preventing the film from becoming wrinkled, and the rib from being torn or cracked, and allowing the fixing film to be stably driven, without shifting.

Figure 17:
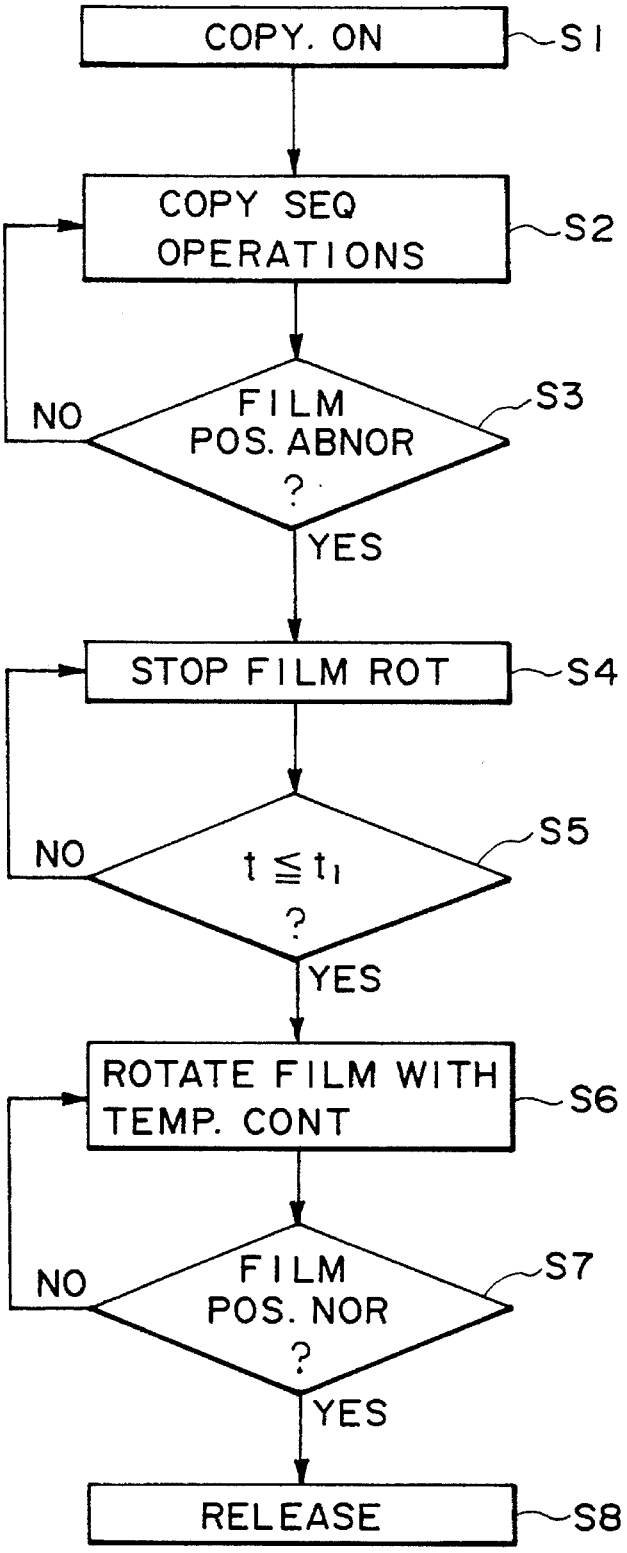
FIG. 17 is a flowchart for a general operation to correct the film member shift in the sixth embodiment of the present invention.

Next, referring to FIGS. 17 to 19, the operation of this embodiment will be described. FIG. 17 is a flowchart for the operation of the fixing apparatus according to this embodiment. During the copying operation, when the film shift occurs in the axial direction and the resultant abnormal film position is detected, the power supply to the heater is interrupted and the film rotation stops (S1–S4). Then, after an elapse of a predetermined duration $t_1$, the operation of the fixing apparatus is restarted (hereinafter, called "idling") under the temperature control with a target temperature of T° C. (S5–S6). As a result, the film returns to the normal position.

Figure 18:
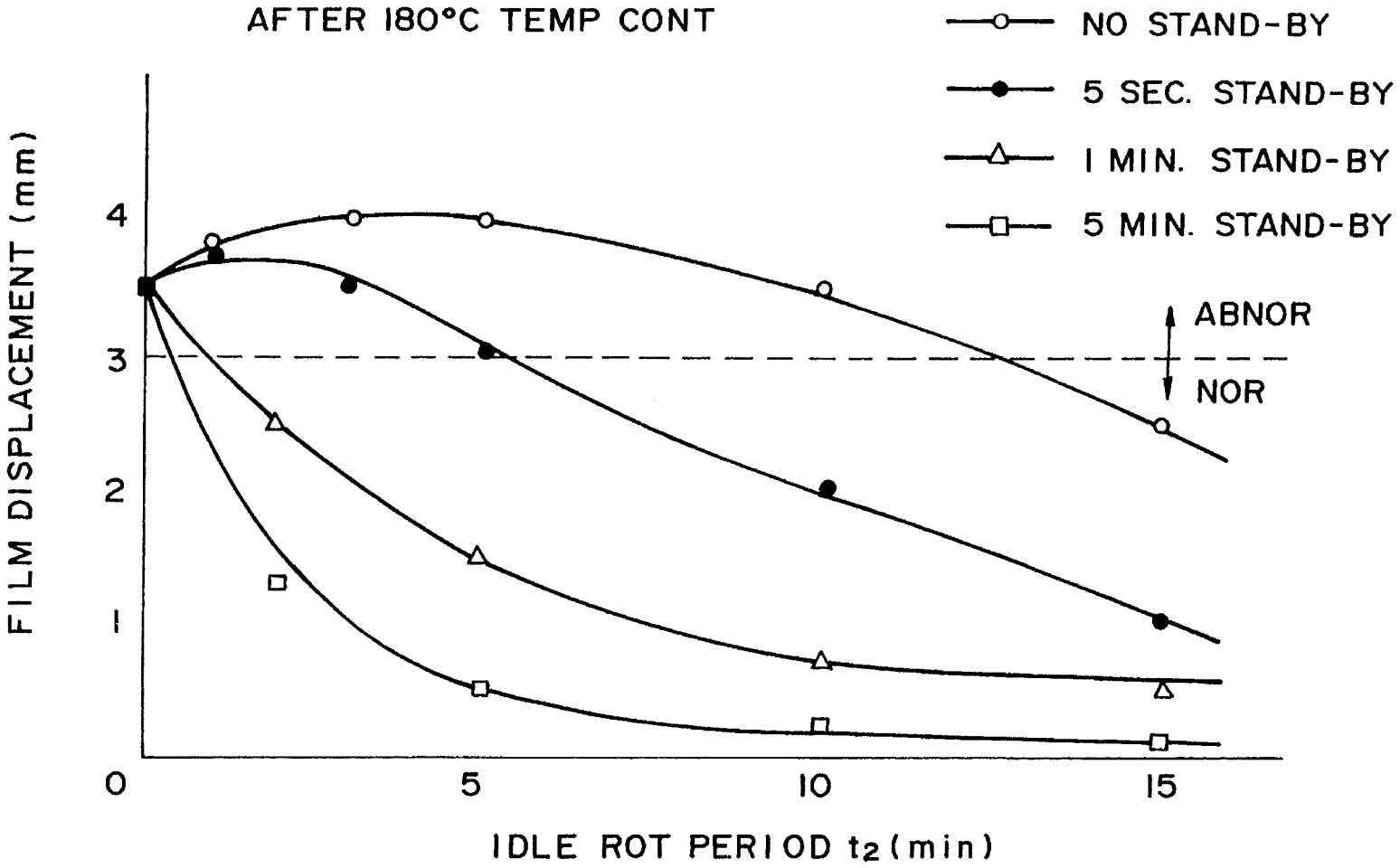
FIG. 18 is a graph of the changes in the amount of film shift during the idle film rotation, with a supporting member temperature being the parameter, in the apparatus shown in FIG. 12.

FIG. 18 shows the changes in the film position during the idle rotation of the film after the fixing apparatus was continuously operated under a temperature controlled at 180° C.; the film shifted to an abnormal position; the operation of the fixing apparatus was interrupted in response to the detection of the anomaly; and a duration of $t_1$ second passed. When the film was idled immediately after the fixing apparatus operation was interrupted, the film further shifted, increasing thereby the time needed for the film to return to the normal position. In comparison, when the film was left stationary for a predetermined duration, the film returned more quickly to the normal range, wherein the smaller the value of T was, the shorter was the idling time $t_2$ it took for the film to return to the normal track.

Figure 19:
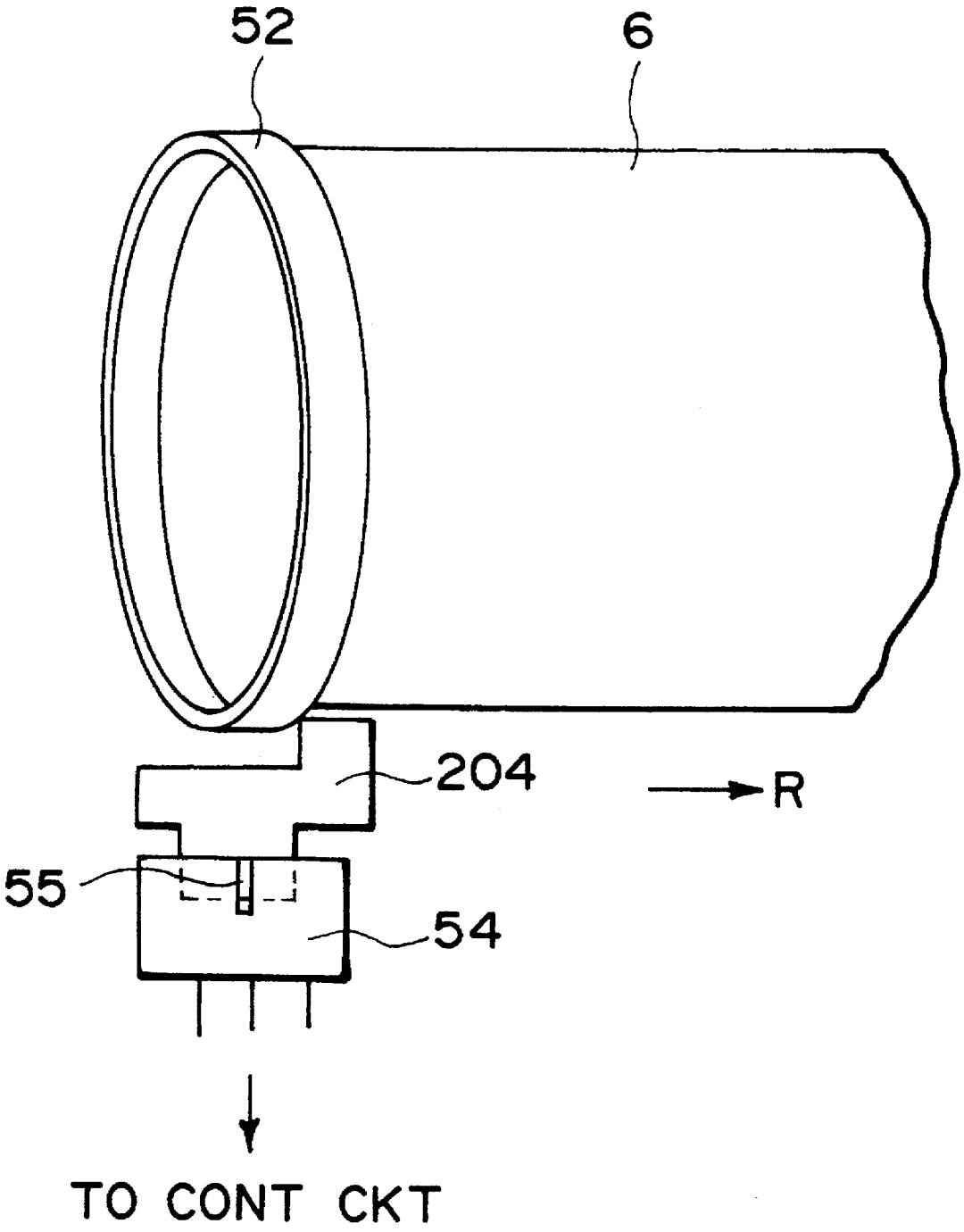
FIG. 19 is a schematic view of the film member and the film member position detecting means in the apparatus in FIG. 12, depicting their general structures.

FIG. 19 shows a method for detecting the film position anomaly. As the film 6 moves in the direction indicated by an arrow R, a load is inflicted upon the regulating member 204 through the rib 52, being thereby moved also in the R direction. As a result, the flag portion 55 of the regulating member 204, which has been shielding the optical sensor 54 before the movement of the regulating member 204, also moves, changing thereby the state of the optical switch from ON to OFF. This signal is sent to the control circuit.

In this embodiment, the flag portion 55 is 8 mm in width, and in the initial setting, its center point is aligned with the center of the optical sensor 54. When it shifts by a distance of 4 mm, a signal is generated to be sent to the control circuit, whereby the abnormal amount (4 mm) of the film shift is detected.

Figure 20A:
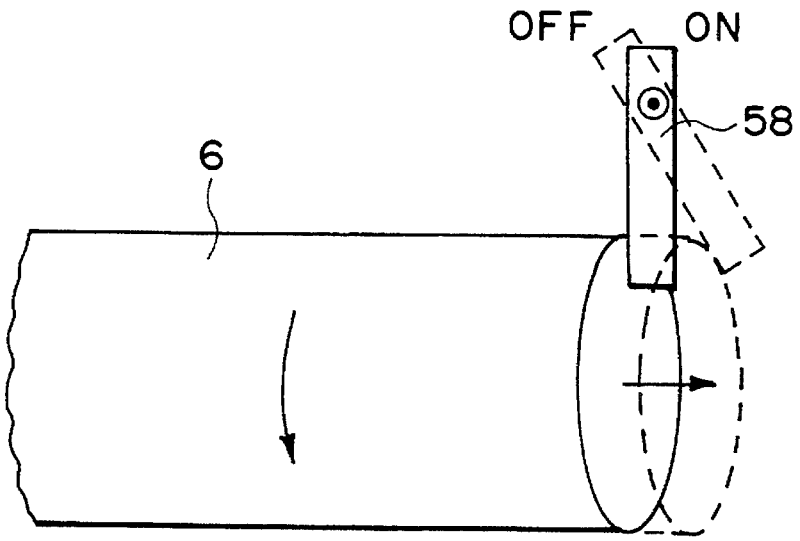
FIGS. 20(*a*) and 20(*b*) are a schematic view of a different form of the film member position detecting member in the sixth embodiment of the present invention.
Figure 20B:
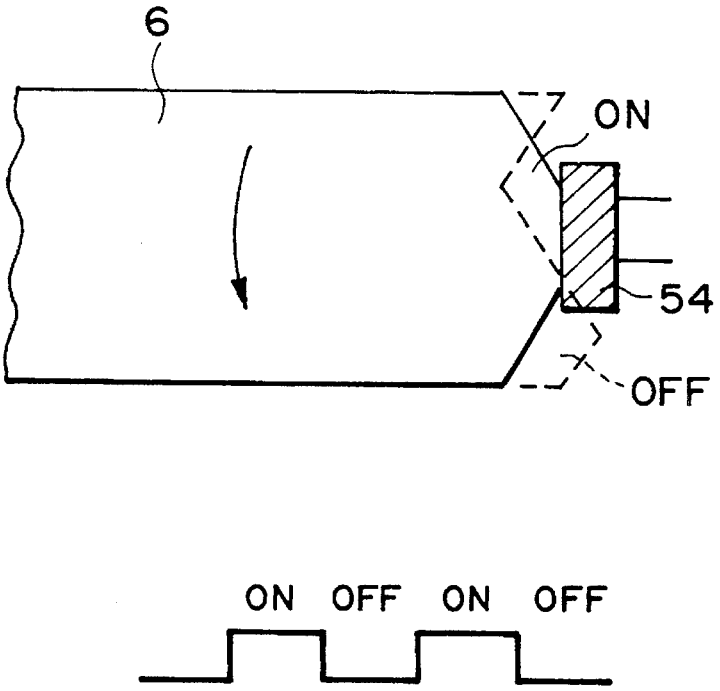

However, the method for detecting the film position is not limited to the one described in the foregoing. There are many other applicable methods. For example, the film position may be detected by a lever as shown in FIG. 20(*a*), or the angular cutaway portion of the film edge shown in FIG. 20(*b*) is optically detected, and the ratio between the ON and OFF periods may be used to determine the film position. Further, a distance of 4 mm was set up as the abnormal shifting distance, but a much longer distance may be set up within the limitation of the apparatus structure. Also, the tolerable shifting distance may be differently set up between the right and left sides of the film.

According to the studies made by the inventors, it was preferable that the duration $t_1$ in which the fixing apparatus operation was to be suspended satisfied: $5\ \text{sec} \leqq t_1 \leqq 60\ \text{min}$, more preferably: $1\ \text{min} \leqq t_1 \leqq 30\ \text{min}$.

Embodiment 7

Next, referring to FIG. 21, the seventh embodiment of the present invention will be described. The same components as those in Embodiment 6 are designated by the same reference numerals to omit their descriptions.

Figure 21:
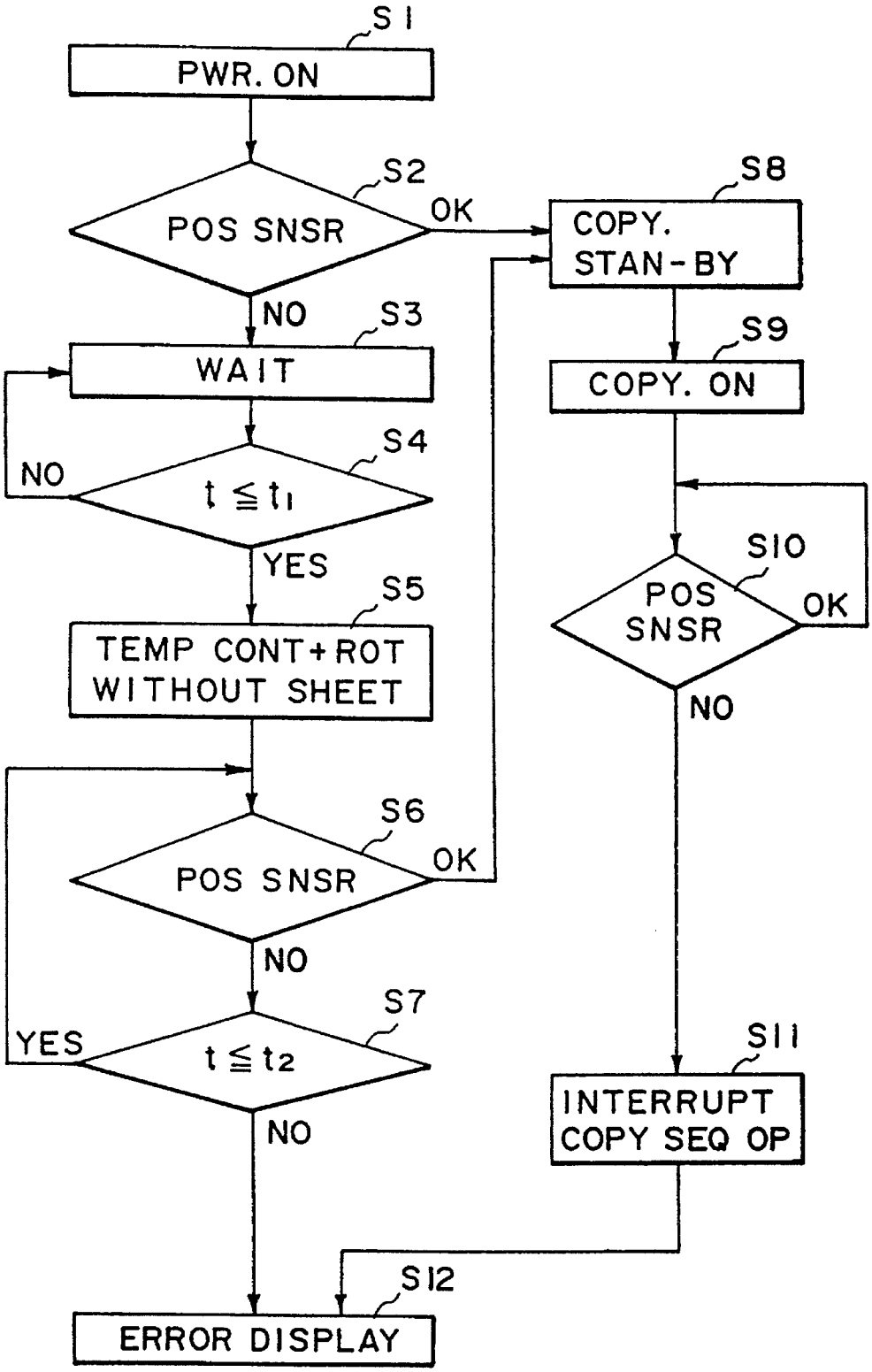
FIG. 21 is a flowchart for a general operation to correct the film member shift in the seventh embodiment of the present invention.

FIG. 21 is a flowchart for the general operation of this embodiment. The power switch is turned on in S1, and the presence of anomaly or normalcy in the film position is detected in S2.

When an anomaly is detected, the fixing apparatus enters the standby state, and after an elapse of a predetermined duration of $t_1$, the idle rotation of the film is started. Hereafter, when it is detected that the film has returned to the normal position, the operation returns to the normal copying sequence, and when the film is still at an abnormal position, the idle film rotation is continued, but the duration of this idling rotation is measured in S7, wherein when the idling lasts more than a duration of $t_2$, the idling is stopped, and an error message is displayed.

During the copying operation (S8, S9), when the positional anomaly is detected, the copying sequence is interrupted, and an error message is displayed. After the error message is displayed, it is necessary to turn on the main switch; therefore, the operation returns to S1.

By the application of this embodiment, the apparatus is provided with functions to limit the duration of the idling, and to display the error message; therefore, even when the film position is erroneously detected to be abnormal, due to the malfunctioning or the like of the detecting element or the like, the idle film rotation is not going to continued for an excessively long period, and also, the operator can be informed of the anomaly.

Figure 22:
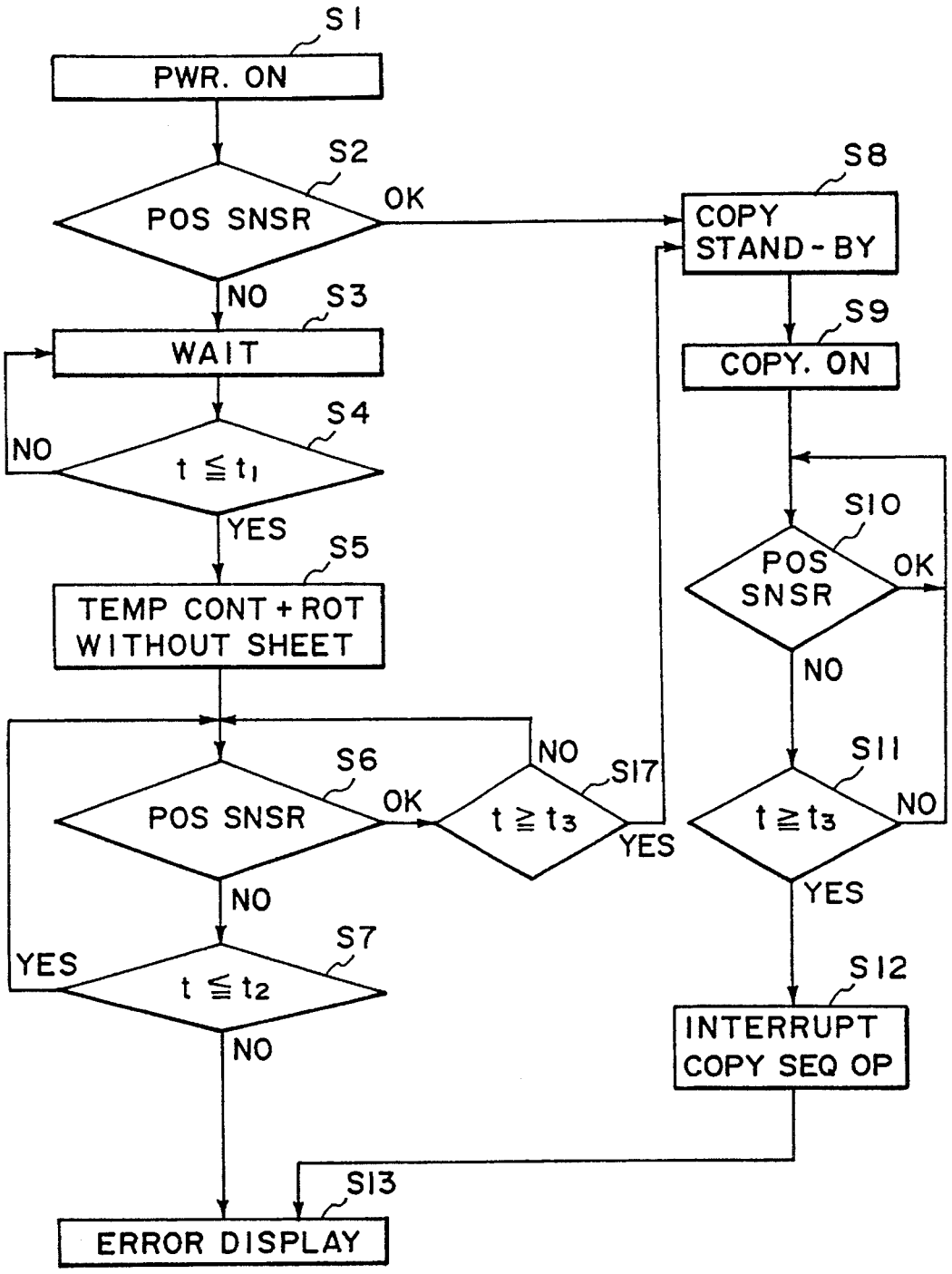
FIG. 22 is an oblique view of the film member position detecting means in the eighth embodiment of the present invention, depicting the general structure.

FIG. 22 is a flowchart for the operation of the image forming apparatus according to this embodiment. In FIG. 22, when the film position is determined to be normal by the position sensor in S6, the operation proceeds to S17, where when $t \geqq t_3$, the apparatus enters the copy-standby state in S8. When t does not satisfy: $t \geqq t_3$, in S17, the film position is re-detected by the position sensor in S6. Thus, unless the position sensor sends out the OK signal for more than the predetermined duration of $t_3$, the apparatus cannot enter the standby state.

Therefore, the state of the optical sensor is prevented from being repeatedly changed between ON and OFF by the oscillation of the rib or the like, preventing thereby erroneous operations. The relation between stages S11 and S10 is the same as that between the stages S6 and S17.

While the invention has been described with reference to the embodiments of the present invention, it is not confined to the details set forth and this application is intended to cover such modifications or changes as may come within the purposes of the improvements or scope of the following claims.

What is claimed is:

1. An image heating apparatus comprising:

a heater having a heat generating element for generating heat upon power supply thereto;

power supply control means for controlling power supply to said heat generating element;

an endless belt for transferring heat from said heater to an image on a recording material;

driving means for driving said endless belt;

drive control means for controlling said driving means; and detecting means for detecting that said endless belt is laterally shifted beyond a predetermined range;

wherein said power supply control means stops power supply to said heat generating element in response to an output of said detecting means, and said drive control means stops said driving means, and said drive control means automatically resumes said driving means upon temperature decrease thereafter.

2. An image heating apparatus according to claim 1, wherein said power supply control means interrupts the driving operation of said driving means after interrupting the power supply to said heating member.

3. An image heating apparatus according to claim 1, wherein said image heating apparatus is for use as a fixing apparatus of an image forming apparatus, and said image forming apparatus interrupts the image forming operation when said detecting means detects that said endless belt has shifted beyond the predetermined degree.

4. An image heating apparatus according to claim 3, wherein said image forming apparatus further comprises displaying means for displaying an error message in response to the output of said detecting means.

5. An image heating apparatus comprising:

a heater;

an endless belt for transferring heat from said heater to an image on a recording material;

driving means for driving said endless belt;

drive control means for controlling said driving means; and detecting means for detecting that said endless belt is laterally shifted beyond a predetermined degree;

wherein said drive control means stops said driving means on the basis of an output of said detecting means, and said drive control means resumes said driving means a predetermined period after the stop.

6. An image heating apparatus comprising:

a heater;

an endless belt for transferring heat from said heater to an image on a recording material;

driving means for driving said endless belt;

drive control means for controlling said driving means;

first detecting means for detecting that said endless belt is laterally shifted beyond a predetermined degree;

second detecting means for detecting a temperature in said apparatus;

wherein said power supply control means stops power supply to said heat generating element in response to an output of said first detecting means, and said drive control means stops said driving means, and said drive control means automatically resumes said driving means upon temperature detected by said second detecting means decrease to a predetermined level.

7. An apparatus according to claim 6, wherein said detecting means detects a temperature of said heater.

8. An apparatus according to claim 6, wherein said driving means has a driving roller, and said second detecting means detects a temperature of said driving roller.

* * * * *

UNITED STATES PATENT AND TRADEMARK OFFICE

CERTIFICATE OF CORRECTION

PATENT NO. : 5,475,194
DATED : December 12, 1995
INVENTOR(S) : OSAMU WATANABE, ET AL.

It is certified that error appears in the above-indentified patent and that said Letters Patent is hereby corrected as shown below:

Column 5,
line 56, "displayed." should read --displayed in S10.--; and
line 57, "displayed in S10," should read --displayed,--.

Column 8,
line 10, "diving" should read --driving--.

Column 10,
line 45, "continued" should read --continue--.

Signed and Sealed this

Twenty-third Day of April, 1996

Bruce Lehman

BRUCE LEHMAN

*Commissioner of Patents and Trademarks*

*Attest:*

*Attesting Officer*